US008264306B2

(12) United States Patent
Baek

(10) Patent No.: US 8,264,306 B2
(45) Date of Patent: Sep. 11, 2012

(54) MOVABLE CONTACTOR ASSEMBLY FOR CURRENT LIMITING TYPE MOLDED CASE CIRCUIT BREAKER

(75) Inventor: Ki Ho Baek, Chungcheongbuk-Do (KR)

(73) Assignee: LS Industrial Systems Co., Ltd., Anyang (KR)

( * ) Notice: Subject to any disclaimer, the term of this patent is extended or adjusted under 35 U.S.C. 154(b) by 0 days.

(21) Appl. No.: 13/010,698

(22) Filed: Jan. 20, 2011

(65) Prior Publication Data

US 2011/0193660 A1 Aug. 11, 2011

(30) Foreign Application Priority Data

Jan. 20, 2010 (KR) ..... 10-2010-0005322

(51) Int. Cl.
*H01H 75/00* (2006.01)
*H01H 77/00* (2006.01)
*H01H 83/00* (2006.01)

(52) U.S. Cl. ..... 335/15; 335/171; 200/400

(58) Field of Classification Search ..... 335/23–25, 335/35–42, 83, 165–176, 15, 16; 200/400–401
See application file for complete search history.

(56) References Cited

U.S. PATENT DOCUMENTS 5,023,416 A * 6/1991 Oyama et al. ..... 200/244
5,082,996 A * 1/1992 Takahashi et al. ..... 200/401
6,798,324 B2 * 9/2004 Richter ..... 335/172
6,911,614 B2 * 6/2005 Asano et al. ..... 200/401
2003/0038695 A1 * 2/2003 Kramer ..... 335/172

FOREIGN PATENT DOCUMENTS

| | | |
|---|---|---|
| JP | 60-157115 | 8/1985 |
| JP | 63-284731 | 11/1988 |
| JP | 5-225889 | 9/1993 |
| JP | 07-006681 | 1/1995 |
| JP | 11-040039 | 2/1999 |
| KR | 2000-0015647 | 3/2000 |

* cited by examiner

*Primary Examiner* — Bernard Rojas
(74) *Attorney, Agent, or Firm* — Lee, Hong, Degerman, Kang & Waimey

(57) ABSTRACT

A movable contactor assembly for a current limiting type MCCB comprising: a terminal base; a plurality of movable contactors having a cam surface portion; a pair of holder plates supporting the movable contactors; a plurality of first springs providing an elastic force to the movable contactors; a plurality of extending plate portions provided to face the side of one end portion of each of the movable contactors so as to be electrically connected with the movable contactors; a plurality of flexible wire plates electrically connecting the movable contactors and the terminal base and having a portion bendable toward the movable contactors or toward the extending plate portions; and a second spring providing an elastic force to the flexible wire plates so as to be tightly attached to the movable contactor.

7 Claims, 14 Drawing Sheets

MOVABLE CONTACTOR ASSEMBLY FOR CURRENT LIMITING TYPE MOLDED CASE CIRCUIT BREAKER

CROSS-REFERENCE TO A RELATED APPLICATION

Pursuant to 35 U.S.C. §119(a), this application claims the benefit of earlier filing date and right of priority to Korean Application 10-2010-005322, filed on Jan. 20, 2010, the content of which is incorporated by reference herein in its entirety.

BACKGROUND OF THE DISCLOSURE

1. Field of the Invention

The present invention relates to a molded case circuit breaker (abbreviated as MCCB hereinafter) and, more particularly, to a large capacity movable contactor assembly for a current limiting type MCCB having a plurality of contacts for each phase (pole).

2. Description of the Related Art

In general, a MCCB is an electric device for protecting an electrical load and an electric circuit by breaking a fault current, such as an overcurrent, an instantaneous large current, or a short-circuit current that occurs in the electric circuit between an electric power source and the electrical load.

In particular, a large capacity MCCB is largely used as electric power distribution equipment for protecting a circuit and a load device against a fault current in a large capacity electric power consuming locality such as a building, a factory, and the like.

A current limiting type MCCB, among the foregoing MCCBs, includes a stationary contactor having a bent shape, such as a "U" shape, so the direction in which current flowing through the stationary contactor and the direction in which current flows through the movable contactor are the opposite. In the current limiting type MCCB, when a fault current occurs, a current limiting operation is performed such that a movable contactor is separated from the fixed contactor by an electromagnetic repulsive force between the movable contactor and the fixed contactor whose currents flow in the opposite direction, before an interlocking operation between a trip mechanism which detects the generated fault current and a switching mechanism for driving the movable contactor such that the movable contactor is separated, namely, tripped, from the fixed contactor by a trigger of the trip mechanism.

Because the large capacity current limiting type MCCB has a large current capacity, a plurality of movable contacts and fixed contactors are installed for each phase of the electric circuit connected to the MCCB, e.g., three-phases alternating current circuit, so that current can dividedly flow through the plurality of movable contactors and fixed contactors.

The present invention relates to a movable contactor assembly for such a large capacity current limiting type MCCB. An example of a movable contactor assembly for a large capacity current limiting type MCCB according to the related art will now be described with reference to FIGS. 1 to 3.

FIG. 1 is an perspective view showing the configuration of the movable contactor assembly for the current limiting type MCCB according to the related art. FIG. 2 is a perspective view showing an internal configuration of the movable contactor assembly without a holder and a spring holder in FIG. 1. FIG. 3 is a front view of the movable contactor assembly of FIG. 1.

As illustrated, the movable contactor assembly for the current limiting type MCCB according to the related art includes a terminal base 18, a movable contactor 11, a holder 12, a spring holder 13, a catch 16, spring support pins 15, and springs 14.

The terminal base 18, which is provided for each phase (in other words each pole) of an AC circuit to which the MCCB is connected, is a conductive member electrically connected to the movable contactor 11. The terminal base 18 is fixedly installed at a case (in other words at an enclosure) of the MCCB, and electrically connected to an external electric power source or an electric load. As shown in FIG. 3, the terminal base 18 includes an extended portion 18*a* which extends from the terminal base 18 and is brought into contact so as to be electrically connected to the movable contactor 11.

A plurality of movable contactors 11 are provided for each of the phases (poles) of the AC circuit to which the MCCB is connected. The movable contactors 11 are connected with the terminal base 18 by the means of connection pins (no reference number given) and rotatable centering around the connection pins. When a portion where a contact is positioned in the movable contactor 11 is a front portion, a contact surface 11*a* contacted by a roller 17 (to be described) when the movable contactors 11 is rotated in the current limiting operation is a front portion, the opposite side of the front side, namely, an outer circumferential surface of the rear end portion (refer to reference numeral 11*b* in FIG. 3), is configured to include a slant surface portion and curved surface portion.

The holder 12 is coaxially connected to the terminal base 18 together with the movable contactors 11 by the connection pins. The holder 12 is rotated, along with the movable contactors 11, to a circuit opening position or a circuit closing position upon receiving a switching driving force from a switching mechanism (not shown) for switching the movable contactors 11 through a link.

The spring holder 13 is fixedly connected to the holder 12, and supports one end portion of each of the spring support pins 15. With reference to FIG. 1, the spring holder 13 includes a plurality of pin through holes allowing one end portion of each of the spring support pins 15 to pass therethrough.

The catch 16 is fixedly coupled to the terminal base 18 and positioned in a rotation path of the movable contactors 11 to limit the rotation range of the movable contactors 11.

As shown in FIGS. 1 and 2, a plurality of spring support pins 15 are provided for each of the phases (poles) of the AC circuit to which the MCCB is connected, and each of the spring pins 15 has one end portion extending through the pin through hole and the other end extending toward the movable contactor 11. Each of the spring support pins 15 is a member having a rod-shape. One end portion of each of the spring support pins 15 is pointy, and a spring seat portion for supporting the springs 14 and the rotatably supported roller 17 are provided at the other end of each of the spring support pins 15. Each of the spring support pins 15 can be linearly movable according to a position at which the roller 17 comes into contact with the contact surface 11*a* of the movable contactor, and accordingly, the pointy one end portion of each of the spring support pins 15 can be linearly movable through the pin through hole of the spring holder 13.

Each of the springs 14 is configured as a coil spring and is disposed to cover an outer circumferential surface of the sprig support pins 15. When a current limiting operation is performed, the roller 17 is brought into contact with the contact surface 11*a* of the movable contactor 11 according to the rotation of the movable contactor 11. Namely, in FIG. 2, when the roller 17 comes into contact with a lower end of the slant surface portion and the curved surface portion of the contact face 11*a*, the spring 14 extends to provide a moment to the movable contactor 11 for the movable contactor 11 to rotate counterclockwise (here, the counterclockwise direction is a direction in which the movable contactor 11 is brought into contact with a not shown fixed contactor). As the roller 17 approaches an upper end of the slant surface portion of the contact face 11*a*, the spring 14 is compressed to reduce the moment applied to the movable contactor 11

FIG. 3 shows a case in which three movable contactors 11 are installed for each phase of the AC circuit to which the MCCB is connected, and the three movable contactors 11 have a rear end portion 11*b*, respectively. The terminal base 18 has a plurality of extending portions 18*a* formed to be spaced apart by a predetermined distance to allowing the rear end portions 11*b* of the movable contactors 11 to be inserted therebetween. The rear end portions 11*b* of the movable contactors 11 and the extending portions 18*a* of the terminal base 18 are in contact with each other such that they can be electrically connected. In order for the rear end portions 11*b* of the movable contactors 11 and the extending portions 18*a* of the terminal base 18 to be in contact with each other stably, the rear end portions 11*b* of the movable contactors 11 and the extending portions 18*a* of the terminal base 18 are in contact with each other in a state of being inserted in an accommodation space for their mutual contact, and a Belleville spring (which is also called a Belleville washer) (not shown) or a wave washer (not shown) are inserted between the rear end portions 11*b* of the movable contactors 11 and the extending portions 18*a* of the terminal base 18 in order to provide an elastic force to the extending portion 18*a* of the terminal base 18 so that the extending portion 18*a* can be brought into contact with the rear end portions 11*b* of the movable contactors 11.

However, the movable contact assembly for the current limiting type MCCB as described above has a structure in which the extending portions 18*a*, which have a poor flexibility, are pushed to be brought into contact with the rear end portions 11*b* of the movable contactors 11 by the Belleville washer or the wave washer, and in this case, because the contact area between the extending portions 18*a* of the terminal base 18 and the rear end portions 11*b* of the movable contactors 11 is narrow and has a high contact resistance, making a loss of electric power transmission.

Also, in the movable contactor assembly for the current limiting type MCCB, the configuration of the spring mechanism for applying elastic force for the contact pressure of the movable contactors includes three springs 14, three spring support pins 15 and three rollers 17, and the coupling means (spring sheets, a pin connection extending plate, a roller support pin) of the rollers 17 and the spring support pins 15, and the spring holder 13 are all installed within the holder 12, and because there are so many components, the assembling productivity is degraded.

In addition, in the movable contactor assembly for the current limiting type MCCB, the spring support pins 15 are formed to be elongate, they must be formed through being cut by a lathe in order to satisfy the strength tolerating the elastic force of the springs 14. Thus, much time is taken to fabricate the spring support pins 15 and the fabrication cost is increased.

SUMMARY OF THE INVENTION

Therefore, in order to address the above matters, the various features described herein have been conceived.

An aspect of the present invention provides a movable contactor assembly for a current limiting type MCCB capable of improving the efficiency of electric power transmission between a movable contactor and a terminal base, improving assembling productivity by reducing the number of components, and quickly providing a spring support mechanism at a low cost through pressing.

According to an aspect of the present invention, there is provided a movable contactor assembly for a current limiting type molded case circuit breaker, the assembly comprising:

a terminal base formed of an electric conductor that provides a supporting base and fixedly installed on a case of the molded case circuit breaker;

a plurality of movable contactors connected to the terminal base by means of a connection pin, provided at each of phases of an Alternating Current, having a cam face portion, and being movable to a position at which the movable contactors are separated from a current limiting type fixed contactors of the molded case circuit breaker by an electromagnetic repulsive force when a fault current occurs in a circuit to which the molded case circuit breaker is connected;

a pair of holder plates connected to the terminal base by a connection pin, supporting the movable contactors at both sides thereof, and being rotatable;

a plurality of first springs provided between the pair of holder plates that provides an elastic force to the movable contactors in a direction in which the movable contactors are brought into contact with the fixed contactors when the molded case circuit breaker is in a closed circuit state, and providing an elastic force to the movable contactors in a direction in which the movable contactors are separated from the fixed contactor when the molded case circuit breaker performs a current limiting operation;

a plurality of extending plate portions formed to extend from the terminal base, and provided to face the side of one end portion of each of the movable contactors so as to be electrically connected with the movable contactors;

a plurality of flexible wire plates having a portion fixedly connected to the terminal base and a portion extending between the movable contactors and the extending plate portions to electrically connect the movable contactors and the terminal base and bendable toward the movable contactors or toward the extending plate portions; and a second spring installed between the extending plate portions and the flexible wire plates to provide an elastic force to the flexible wire plates so as to be tightly contacted to the movable contactor.

The foregoing and other objects, features, aspects and advantages of the present invention will become more apparent from the following detailed description of the present invention when taken in conjunction with the accompanying drawings.

DETAILED DESCRIPTION OF THE INVENTION

The configuration and operation of a movable contactor assembly for a current limiting type molded case circuit breaker (MCCB) according to preferred embodiments of the present invention will now be described with reference to the accompanying drawings.

First, the overall configuration and operation of the current limiting type MCB including the movable contactor assembly according to a preferred embodiment of the present invention will now be described with reference to FIGS. 4 to 6.

The configuration of the current limiting type MCCB having the movable contactor assembly according to a preferred embodiment of the present invention will be described as follows.

Figure 4:
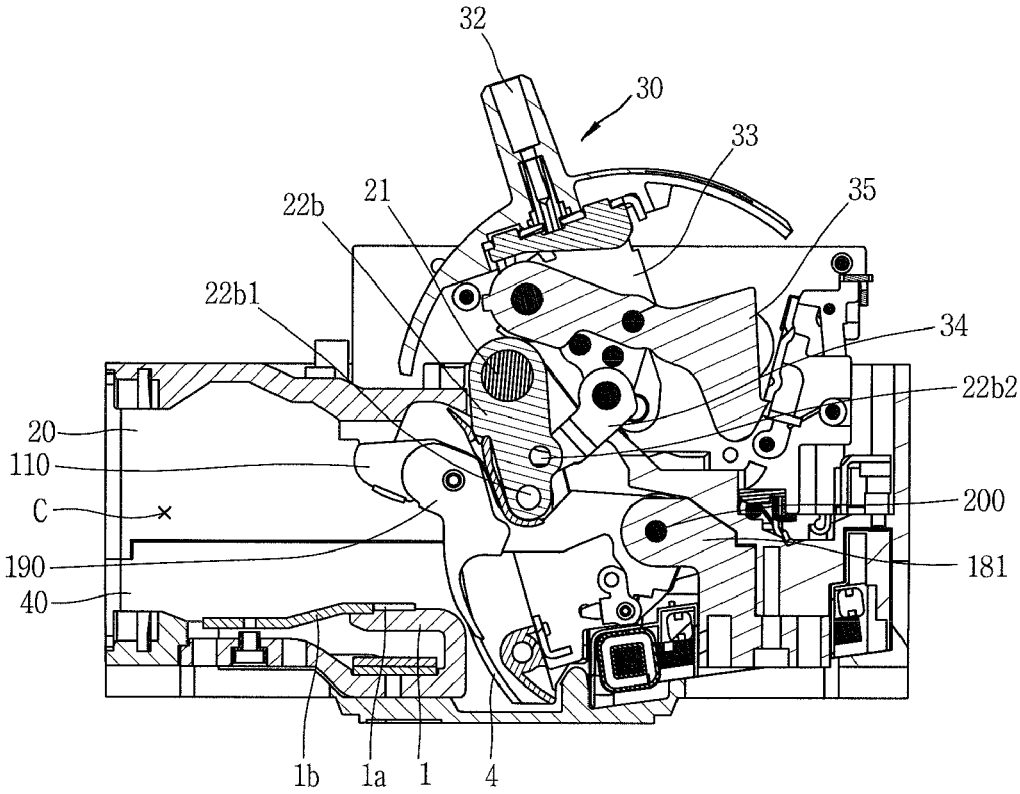
FIG. 4 is a longitudinal sectional view showing an overall configuration of a large capacity current limiting type MCCB having a movable contactor assembly according to a preferred embodiment of the present invention.
Figure 5:
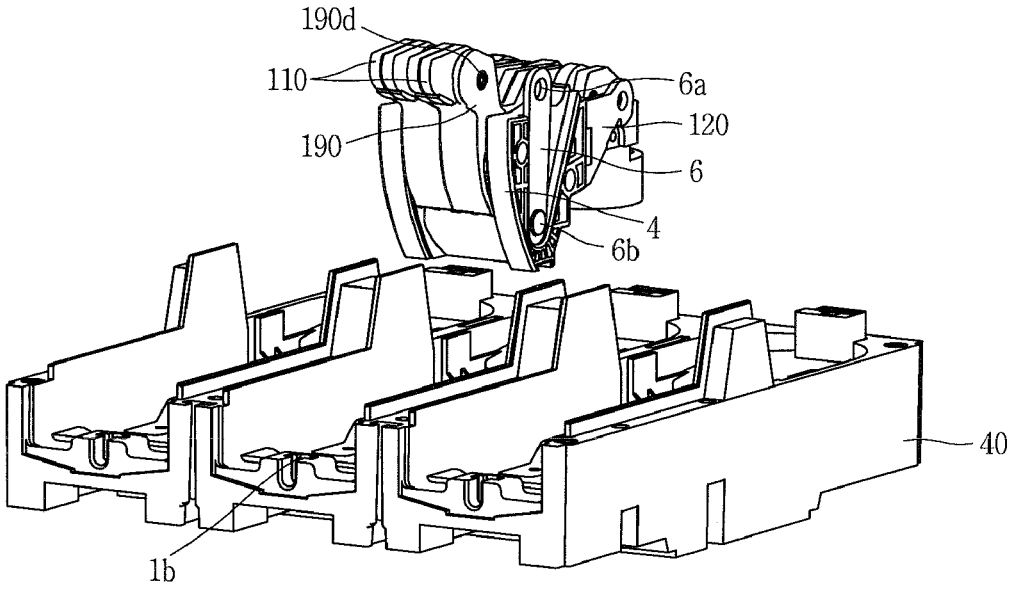
FIG. 5 is an exploded perspective view of the movable contactor assembly and a lower case of the MCCB according to a preferred embodiment of the present invention.
Figure 6:
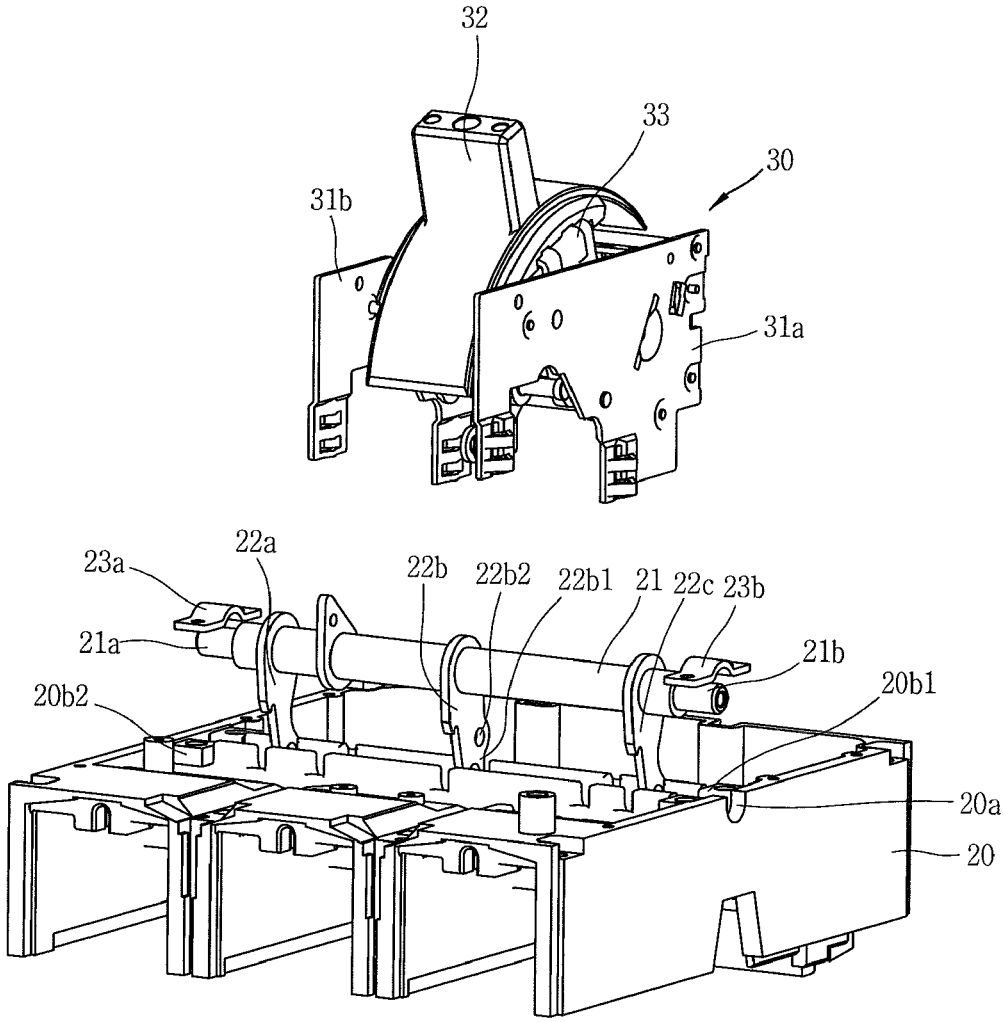
FIG. 6 is a perspective view showing the configuration of a switching mechanism, a shaft for driving the movable contactor assemblies of a plurality of phase (poles), and upper links in the MCCB in FIG. 4.

With reference to FIGS. 4 to 6, the current limiting type MCCB according to an preferred embodiment is configured to comprise, starting from the element positioned at the top, a switching mechanism 30, a shaft 21, links 6, 22*a*, 22*b*, and 22*c*, a movable contactor 110, a lower arc shielding plate 3, holders 4, 120, a fixed contactor 1, an upper case 20, and a lower case 40.

As well known, the switching mechanism 30 is a driving mechanism for discharging elastic energy charged in a state in which a spring called a trip spring (not shown) or a main spring (not shown) is tensed to enable the movable contactor 110 to be rapidly rotated to a position at which the movable contactor 110 is separated from the fixed contactor 1 by virtue of the elastic energy.

To this end, the switching mechanism 30 comprises a pair of side plates 31*a* and 31*b* provided as supporting base plates, a handle 32 for providing means for manually switching the circuit, a lever 33 connected to a lower portion of the handle 32 and extending to the lower portion in order to provide a rotation support point of the handle 32, a second link member 34 including upper and lower link members and transmitting a driving force of the trip spring, the trip spring having one end portion connected to the lower portion of the handle 32 and a lower end portion connected to connection pins of the upper and lower link members of the second link member 34, a latch 35 having a lock position at which the trip spring is maintained with the elastic energy charged and a releasing position at which the trip spring is released to discharge the elastic energy, and the like. The configuration and operation of the switching mechanism 30 in the MCCB are well known, so a detailed description thereof will be omitted.

The shaft 21 is a means which is connected to the switching mechanism 30 so as to be rotatable according to a driving of the switching mechanism 30, and provides a driving force for rotating the movable contactor 110. In other words, the shaft 21 penetratingly connects upper links, i.e., an upper link 22*c* for an R phase, an upper link 22*b* for an S phase, and an upper link 22*a* for a T phase, provided for phases (poles) of a three-phases AC circuit. The upper link 22*c* for the R phase, the upper link 22*b* for the S phase, the upper link 22*a* for the T phase, and the shaft 21 may be connected through welding so as to be integrally rotated together. With reference to FIG. 6, a driving pin (not shown) is inserted into a driving pin connection hole 22*b*2 formed at a central portion of the upper link 22*b* for the S phase in a lengthwise direction, among the upper links, and the driving pin is connected to the second link member 34 transferring a driving force of the trip spring in the switching mechanism 30. Thus, the driving force from the switching mechanism 30 rotates the upper link 22*b* for the S phase through the second link member 34, and accordingly, the shaft 30 is rotated in the same direction in which the upper link 22*b* is rotated. According to the rotation of the shaft 30, the other remaining upper link 22*c* for the R phase and the upper link 22*a* for the T phase connected to the shaft 30 are rotated in the same direction. The rotation of the upper link 22*c* for the R phase, the upper link 22*b* for the S phase, and the upper link 22*a* for the T phase is transferred to the movable contactor 110 through the lower link 6 and the holders 4 and 120 to enable the movable contactor 110 to rotate to a circuit opening position (in other words a trip or off position) at which the movable contactor 110 is separated from the corresponding fixed contactor 1 or to a circuit closing position at which the movable contactor 110 is brought into contact with the fixed contactor 1.

The shaft 21 and a peripheral configuration of the shaft 21 will now be described in detail with reference to FIG. 6.

The shaft 21 may be configured as a pipe made of a metal material or a synthetic resin having a proper mechanical strength and having a length corresponding to the width of the upper case 20. Both end portions of the shaft 21 are configured as support end portions 21*a* and 21*b* having a diameter smaller than that of the other middle portions of the shaft 21. A shaft support recess 20*a* of the upper case 20 supporting the support end portion 21*b*, one of the support end portions 21*a* and 21*b*, has a diameter larger by a predetermined air gap than that of the support end portion 21*b* of the shaft 21 but smaller than that of the other middle portion of the shaft 21. Accordingly, in a state in which the shaft 21 is installed on the upper case 20, the shaft 21 can be prevented from being left in an axial direction. The shaft support recess 20*a* of the upper case 20 may be formed only at one of both sides of the upper case 20 or two shaft support recesses may be provided at both sides of the upper case 20.

When the MCCB is a three-poles (three-phases) type MCCB, the three upper links 22*a*, 22*b*, and 22*c* are installed at predetermined intervals, and when the MCCB is a four-poles (four-phases) type MCCB, four upper links may be installed on the shaft 21.

The first support piece 23*a* and the second support piece 23*b* cover the both support end portions 21*a* and 21*b* of the shaft 21 to support the same, so the shaft 21 can be prevented from being left upwardly. In order to allow the shaft 21 to rotate and prevent the support end portions 21*a* and 21*b* of the shaft 21 from being left upwardly, middle portions of the first support piece 22*a* and the second support piece 23*b* are upwardly convex and there is an air gap between middle portions of the first support piece 22*a* and the second support piece 23*b* and upper surfaces of the support end portions 21*a* and 21*b*. A screw hole is provided on both end portions of the first support piece 22*a* and the second support piece 23*b* to allow a fixing screw to penetrate therethrough. Fixing screws penetrate through the corresponding screw holes so as to be fastened to a first screw support portion 20*b*1 and a second screw support portion 20*b*2 provided on the upper case 20 to thus fix the positions of the first support piece 23*a* and the second support piece 23*b* on the upper case 20.

As shown in FIGS. 4 to 6, the links 6, 22*a*, 22*b*, and 22*c* comprise the lower link 6 and the upper links 22*a*, 22*b*, and 22*c*. When the MCCB is a three-poles type MCCB, the upper links 22*a*, 22*b*, and 22*c* may be configured as the upper link 22*c* for the R phase, the uplink 22*b* for the S phase, and the upper link 22*a* for the T phase as mentioned above. When the MCCB is a four-poles type MCCB, an upper link for an N phase (neutral pole) may be further provided in addition to the upper links.

As described above, the upper links 22*a*, 22*b*, and 22*c* are means for transferring a driving force from the switching mechanism 30 to the lower link 6, and are coaxially installed on the shaft 21 at predetermined intervals.

As shown in FIG. 6, a driving pin connection hole 22*b*2 is provided on the upper link 22*b* for the S phase, to which the switching mechanism 30 is driven to be connected, among the upper links 22*a*, 22*b*, and 22*c*, and connected to the second link member 34 of the switching mechanism 30 by, for example, a driving pin. Thus, the driving force from the second link member 34 connected by the driving pin is transmitted to the upper link 22*b* for the S phase to rotate the upper link 22*b* clockwise or counterclockwise. Then, the upper link 22*c* for the R phase and the upper link 22*a* for the T phase coaxially connected with the upper link 22*b* for the S phase are also rotated in the same direction in which the upper link 22*b* for the S phase is rotated, through the shaft 21.

The lower link 6 is a means for transmitting the driving force from the upper links 22*a*, 22*b*, and 22*c* to the insulation holder 4 among the holders 4 and 120, and accordingly, the lower link 6 is provided to correspond to the upper links 22*a*, 22*b*, and 22*c*. Also, when the MCCB is a three-phases type MCCB, a total of six lower links 6 are provided for each phase of a three-phases AC circuit, and when the MCCB is a four-phases type MCCB, a total of eight lower links 6 are provided, and in this case, each pair of lower links 6 correspond to the poles. A link pin connection hole (See the link pin connection hole 22*b*1 of the upper link 22*b* for the S phase) is provided to each of the upper links 22*a*, 22*b*, and 22*c*, so that the upper links 22*a*, 22*b*, and 22*c* are connected to the lower link 6 by a link pin 7*a*.

Meanwhile, the configuration of the movable contactor 110 will be described with reference to FIGS. 4, 5, and 6.

The movable contactor 110 is provided to correspond to the fixed contactor 1. The movable contactor 110 is rotatable to a closing position (in other words an ON position) in which the movable contactor 110 is brought into contact with the fixed contactor 1 to electrically connect the circuit or a trip position (in other words a breaking or OFF position) at which the movable contactor 110 is separated from the fixed contactor 1 to break the circuit. In order to provide a path allowing a relatively large current to be divided to flow, as shown in FIG. 5, a contactor assembly comprising a plurality of contactors (or pairs of contactors) is provided as the movable contactor 110 for each of the AC phases (poles). The respective contactors constituting the movable contactor 110 is configured as an electric conductor plate formed to substantially have an alphabet 'M' shape and having a head portion, a body portion, and a leg portion.

The head portion of each of the contactor comprises a shaft receiving hole allowing the contactor to penetrate in a thicknesswise direction. The shaft receiving hole and another shaft receiving hole corresponding to the shaft receiving hole are aligned to communicate with each other, and a connection pin is inserted into the shaft receiving holes, whereby a lower shielding plate 190 can be installed to be connected to the movable contactor 110. The leg portion (or a rear end portion) of each of the contactors constituting the movable contactor 110 comprises a connection pin hole (not shown). When a connection pin (200 in FIG. 8) is inserted into the corresponding connection pin hole, the movable contactor 110 can be rotatably supported by the terminal base 180.

Because the movable contactor 110 comprises the plurality of contactors and a large current is divided to flow, a conducting capacity of the movable contactor 110 can be increased.

The lower shielding plate 190 is connected to the movable contactor 110 so as to be rotatable along with the movable contactor 110. The lower shielding plate 190 extends downwardly from a lower portion of the movable contactor 110, so when the movable contactor 110 is rotated to the breaking position (or the trip position), the lower shielding plate 190 shields an arc at the lower portion of the movable contactor 110. Accordingly, based on a contact of the movable contactor 110, when a front side of the contact, namely, the side of an arc extinguishing chamber (C) in FIG. 4 is a front side and the rear side of the contact is a rear side, a backward movement of an arc from the lower portion of the movable contactor 110 can be shielded by the lower shielding plate 190.

The configuration and function of the holders 4 and 120 will now be described with reference to FIGS. 4 to 6.

The holders 4 and 120 are connected to the links (See any one of the links 6, 22*a*, 22*b*, and 22*c* in FIG. 4) and made of an electrically insulating material to electrically insulate the link (See any one of the links 6, 22*a*, 22*b*, and 22*c* in FIG. 4). The holders 4 and 120 are means to rotate the movable contactor (See 2 in FIG. 5) by being rotated by the link (See any one of the links 6, 22*a*, 22*b*, and 22*c* in FIG. 4).

The holders 4 and 120 comprise the insulation holder 4 and the pair of holder plates 120.

Figure 7:
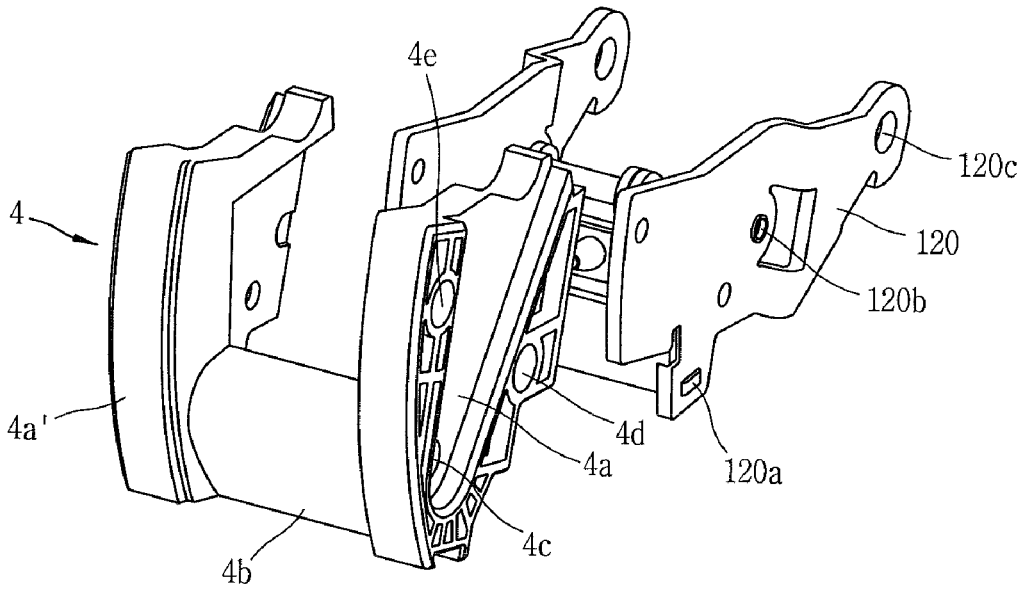
FIG. 7 is a perspective view showing the configuration of an insulation holder and a pair of holder plates of the movable contactor assembly according to a preferred embodiment of the present invention.

As shown in FIGS. 4 to 7, the insulation holder 4 is made of an electrically insulating material to electrically insulate the links 6, 22*a*, 22*b*, and 22*c*, particularly, the lower link 6, and transmits the driving force transferred from the links 6, 22*a*, 22*b*, and 22*c* to the movable contactor 110 through the holder plate 120 to allow the movable contactor 110 to be rotated. For this function, the insulation holder 4 is connected to the holder member 5 and also connected to the links 6, 22*a*, 22*b*, and 22*c*, in particular, to the lower link 6 and installed at both sides of the movable contactor with the movable contactor interposed therebetween. As shown in FIG. 7, the insulation holder 4 comprises a first wall support member 4*a* and a second wall support member 4*a*' provided to be spaced apart by a predetermined distance therebetween. The first wall support member 4*a* and the second wall support member 4*a*' are connected to lower end portions of the lower links 6, which are provided as pairs for each phase (each pole) by connection pins (not shown). In order to connect the lower links 6, the first wall support member 4*a* and the second wall support member 4*a*' comprise a link pin hole 4*c*, respectively. Also, for a connection with the holder plate 120, the first wall support member 4*a* and the second wall support member 4*a*' comprise connection holes 4*d* and 4*e* allowing a connection pin to be inserted thereinto to correspond to a connection hole (no reference number is given) of the holder plate 120.

Figure 1:
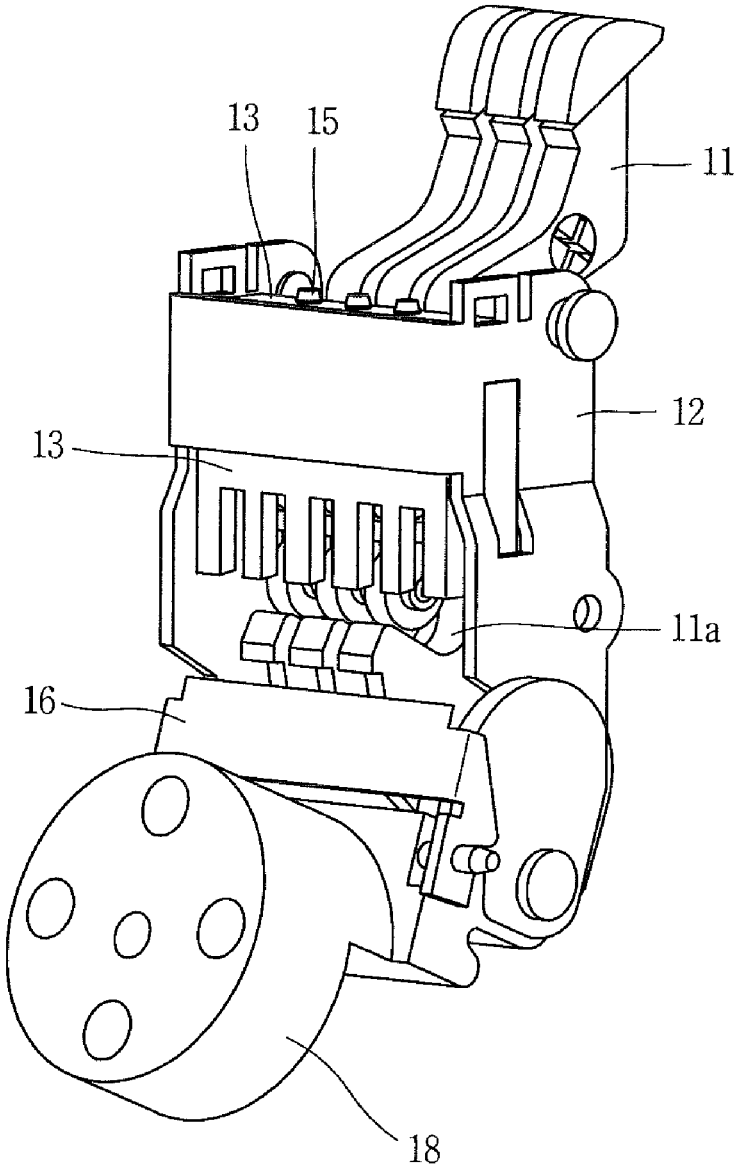
FIG. 1 RELATED ART
FIG. 1 is an outer perspective view showing the configuration of the movable contactor assembly for the current limiting type MCCB according to the related art.
Figure 2:
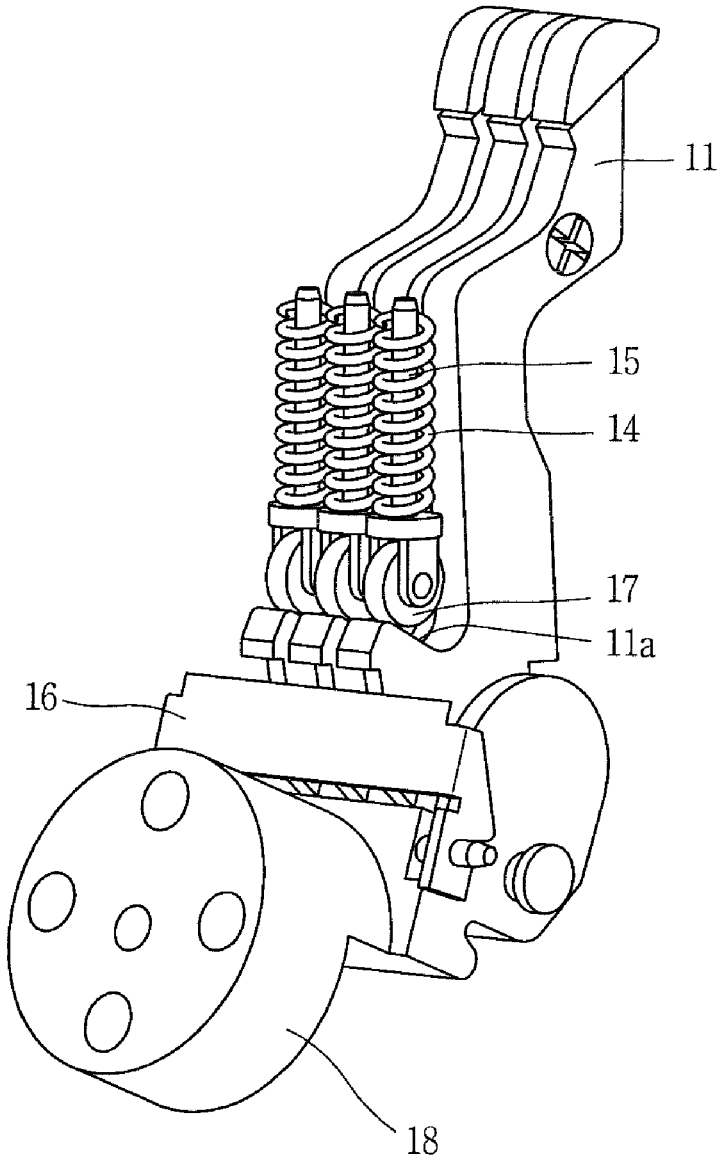
FIG. 2 RELATED ART
FIG. 2 is a perspective view showing an internal configuration of the movable contactor assembly without a holder and a spring holder in FIG. 1.
Figure 3:
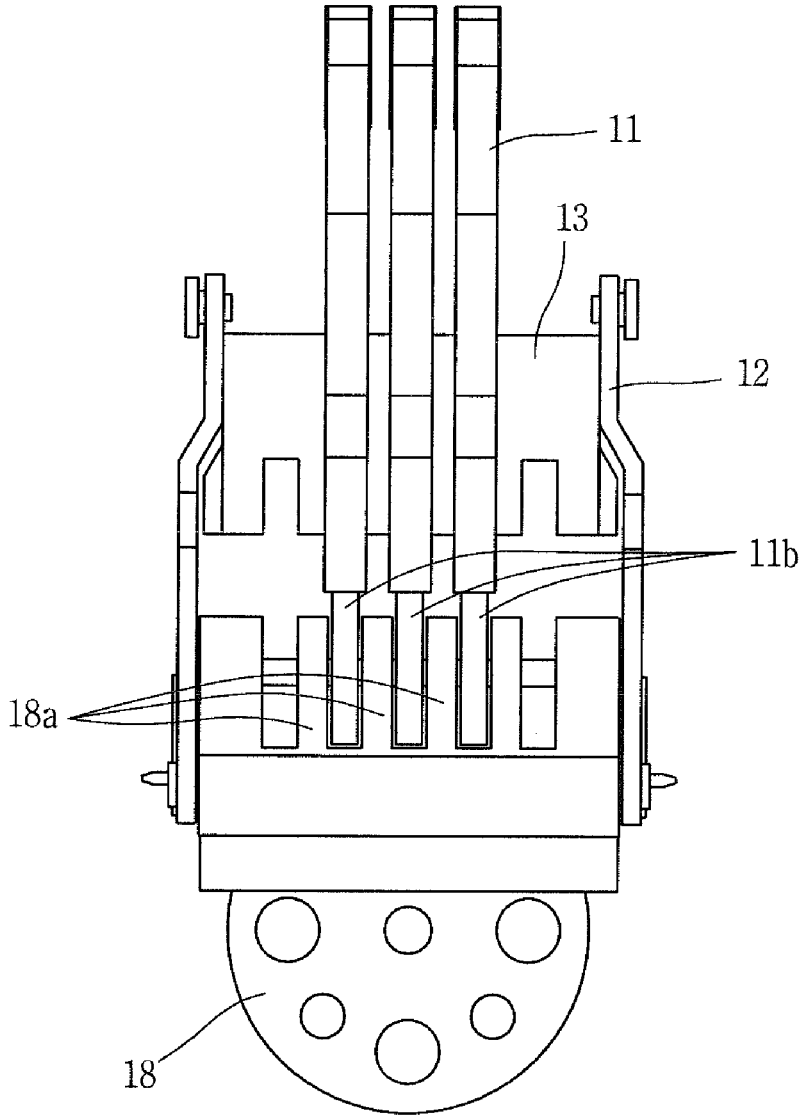
FIG. 3 RELATED ART
FIG. 3 is a front view of the movable contactor assembly of FIG. 1.

As shown in FIG. 7, a lower end shielding plate portion 4*b* is provided between lower end portion of the first wall support member 4*a* and the second wall support member 4*a*' in a traversing manner, and the corresponding lower end shielding plate portion 4*b* provides a means for shielding an arc at a lower side of the lower shielding plate (See 3 in FIG. 2). The first wall support member 4*a*, the second wall support member 4*a*', and the lower end shielding plate portion 4*b* may be made of a synthetic resin material, and may be fabricated through molding by a single mold.

The fixed contactor 1 is electrically connected to an electric power source or an electric load of an AC electric power circuit. A total of three fixed contactors 1 may be provided to the three-phases type MCCB according to the three phases of the R phase, the S phase, and the T phase of the three-phases AC. In a preferred embodiment of the present invention, in case of the three-phases type MCCB, two fixed contactors 1 are provided for each phase to correspond to the plurality of movable contactors 110 provided for each phase. Namely, a total of six fixed contactors 1 are provided. In general, the MCCB according to a preferred embodiment of the present invention largely used for industrial purposes may be configured as a three-phases (three-poles) MCCB or a four-poles MCCB additionally including a ground phase (N pole), and accordingly, a total of six or eight fixed contactors 1 can be provided for each phase (pole). As shown in FIG. 6, the fixed contactor comprises a contact 1*a* corresponding to a contact of the movable contactor 110.

An arc runner 1*b* may be provided to be connected to the contact 1*a* of the fixed contactor 1, and the arc runner 1*b* serves to induce an arc, which is generated between the contact of the movable contactor 110 and the contact 1*a* of the fixed contactor 1 when the movable contactor 110 is separated from the fixed contactor 1 while a large current flows, to move toward the arc extinguishing chamber (C).

The lower case 40 serves to accommodate in insulated manner the movable contactor 110, the fixed contactor 1, and the holders 4, 5, and 8, which are provided by threes in case of the foregoing three-phases MCCB, such that they are insulated among the phases, along with the upper case 20. To this end, the lower case 40 can be molded by using a synthetic resin material having electrical insulation properties, and comprises partition walls formed to be protruded upward from the bottom in order to separate the phases, the fixed contactor 1, and the holders 4, 5, and 8, for each phase. The upper case 20 comprises a plurality of partition walls formed to extend downward in a horizontal direction and, in this case, the number of the plurality of partition walls corresponding to that of the partition walls of the lower case 40.

The operation of the MCCB configured as described above will now be described with reference to FIG. 4.

First, the closing operation, i.e., the ON operation, will now be described with reference to FIGS. 4 and 5.

Figure 16:
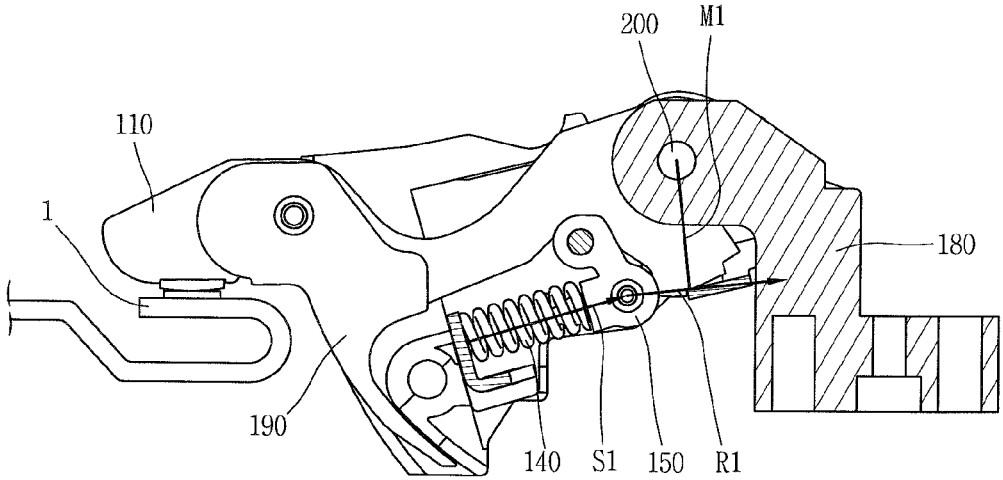
FIG. 16 is a longitudinal sectional view showing an operational state in which the movable contactor is brought into contact with a fixed contactor in the movable contactor assembly according to a preferred embodiment of the present invention.

The handle 32, which is at an OFF position, i.e., the breaking position, at which the handle 32 has been rotated to the right side (clockwise) from the position in FIG. 4, is grasped, and as shown in FIG. 4, the handle 32 is rotated counterclockwise. Here, when the handle 32 is at the OFF position, the latch 35 connected to the lever 33 by a pin is rotated clockwise according to the clockwise rotation of the handle 32 and the lever 33 so as to be in a reset state in which the latch 35 is latched by a latch holder (no reference numeral is given). In this state, namely, in a state in which the latch 35 is locked and a trip spring (not shown) is extended to charge elastic energy and constrained, the handle 32 is rotated counterclockwise as shown in FIG. 4. Then, the trip spring whose upper end portion is supported by the handle 32 is rotated counterclockwise along the handle 32. Accordingly, a lower end portion of the trip spring connected to a link pin of the second link member 34 is rotated counterclockwise by an elastic force of restitution of the trip spring whose upper end portion, middle portion and lower end portion are to form a straight line, so the link pin of the second link member 34 is rotated counterclockwise and the upper and lower link members of the second link member 34 are folded. Then, the upper link (See 22*b* in FIG. 4) whose lower portion is connected to the lower link member of the second link member 34 is rotated clockwise. Accordingly, the lower link (6 in FIG. 5) connected to the upper link by a link pin (not shown) is rotated counterclockwise, and at this time, the insulation holder 4 connected to the lower link 6 by a connection pin, the holder plate (120 in FIG. 5) connected to the insulation holder 4 by a connection pin, and the movable contactor 110 connected to the holder plate 120 by a connection pin (200 in FIG. 8) are also rotated counterclockwise by using the terminal base 180 as a supporting point. Accordingly, the movable contactor 110 is rotated to a position at which the movable contactor 110 is brought into contact with the fixed contactor 1 so as to be in the state as shown in FIG. 16. Accordingly, the circuit is connected between the electric power source and the electric load side to allow current to flow therethrough.

The breaking operation, i.e., a closing operation according to a manual OFF manipulation, and an automatic breaking (trip) operation according to a detection of a fault current will now be described with reference to FIGS. 4 and 5.

First, a breaking operation according to a manual OFF operation from an ON position will now be described.

The handle 32 is grasped at the ON position and rotated to the right side (clockwise) to be at an OFF position. Here, the latch 35 is maintained in the reset state in which the latch 35 is latched by the latch holder (no reference numeral given). In this state, namely, in a state in which the latch 35 is locked and a trip spring (not shown) is extended to charge elastic energy and latched, the handle 32 is rotated clockwise as shown in FIG. 4. Then, the trip spring whose upper end portion is supported by the handle 32 is rotated clockwise along the handle 32. Accordingly, a lower end portion of the trip spring connected to a link pin of the second link member 34 is rotated clockwise by an elastic force of restitution of the trip spring whose upper end portion, middle portion and lower end portion are to form a straight line, so the link pin of the second link member 34 is rotated clockwise and the upper and lower link members of the second link member 34 are unfolded. Then, the upper link (See 22*b* in FIG. 6) whose lower portion is connected to the lower link member of the second link member 34 is rotated counterclockwise. Accordingly, the lower link 6 connected to the upper link by a link pin 7*a* is rotated clockwise, and at this time, the insulation holder 4 connected to the lower link 6 by a connection pin, the holder plate (120 in FIG. 5) connected to the insulation holder 4 by a connection pin, and the movable contactor 110 connected to the holder plate 120 by the connection pin 200 are also rotated clockwise by using the terminal base 180 as a supporting point. Accordingly, the movable contactor 110, which is coaxially connected to the holder plate 120 by the connection pin 200, is rotated to a position at which the movable contactor 110 is separated from the fixed contactor 1 so as to be in the state as shown in FIG. 4. Accordingly, the circuit between the electric power source side and the electric load side is disconnected, and thus, current cannot flow.

An automatic breaking (trip) operation will now be described.

In an ON state, when an abnormal current (or a fault current) such as a short-circuit current occurs in the circuit, a trip mechanism (not shown) including an electromagnet, an armature, or the like, detects the abnormal current and triggers the switching mechanism 30.

Then, the latch holder releases the latch 35 and the latch 35 is rotated counterclockwise in the state as shown in FIG. 4 and the trip spring is contracted from the extended state to the original state, discharging the charged elastic energy. Accordingly, the lower end portion of the trip spring is moved upward to lift upward the link pin of the second link member 34 connected to the lower end portion of the trip spring. Then, the upper and lower links of the second ink member 34 are unfolded, and the upper link (22*b* in FIG. 4) connected to the lower link of the second link member 34 is rotated counterclockwise. Accordingly, the lower link 6 connected to the upper link (22*b* in FIG. 6) by the link pin 7*a* is rotated clockwise, and at this time, the insulation holder 4 connected to the lower link 6 by the connection pin, the holder plate (120 in FIG. 5) connected to the insulation holder 4 by the connection pin, and the movable contactor 110 connected to the holder plate 120 by the connection pin 200 are rotated clockwise by using the terminal base 180 as a supporting point. Accordingly, the movable contactor 110 is rotated clockwise to a position at which the movable contactor 110 is separated from the fixed contactor 1 so as to be in the state as shown in FIG. 4. Accordingly, the circuit between the electric power source side and the electric load side is broken, and thus, current cannot flow.

A current limiting operation of the MCCB according to a preferred embodiment of the present invention will now be described with reference to FIGS. 4 and 5.

When a large fault current, such as a short-circuit current, occurs on the circuit at a position at which the movable contactor 110 is in contact with the fixed contactor 1, namely, at an ON position in the circuit, the trip mechanism detects the fault current as described above. In this case, before the trip mechanism triggers the switching mechanism 30 to perform a trip operation, because the direction in which current flows through the movable contactor 110 is a right direction while the direction in which the current flows through the contact 1*a* of the fixed contactor 1 is a left direction in FIG. 4, which are the opposite, a strong repulsive force, namely, an electromagnetic repulsive force, is generated between the magnetic forces in the same direction generated around the movable contactor 110 and the fixed contactor 1. Such an electromagnetic repulsive force independently rotates the movable contactor 110 in a direction in which the movable contactor 110 is separated from the corresponding fixed contactor 1 regardless of the transmission of a driving force through the switching mechanism 30, the links 6, 22*a*, 22*b*, and 22*c*, and the holders 4 and 120. This operation is called a current limiting operation, and FIG. 4 shows such a current limiting operation. It is noted from FIG. 4 that, in case of the current limiting operation, the switching mechanism 30, the links 6, 22*a*, 22*b*, and 22*c*, and the holders 4 and 120 are maintained at the position in the ON state.

The configuration and operation of the movable contactor assembly for the current limiting type MCCB according to a preferred embodiment of the present invention will now be described with reference to FIGS. 8 to 18.

The movable contactor assembly 100 for the current limiting type MCCB according to an preferred embodiment of the present invention comprises the terminal base 180, the movable contactor 110, the holder plate 120, the plurality of first springs 140, the plurality of extending plate portions 181, 183, and 185, the plurality of flexible wire plates 170, and the second springs PS1 and PS2.

The terminal base 180 is formed of an electrical conductor. Also, the terminal base 180 provides a supporting base to the movable contactor 110 such that the movable contactor 110 can be rotatably supported by the terminal base 180. In addition, as shown in FIGS. 4 and 5, the terminal base 180 is fixedly installed at the case 40 of the MCCB.

Figure 9:
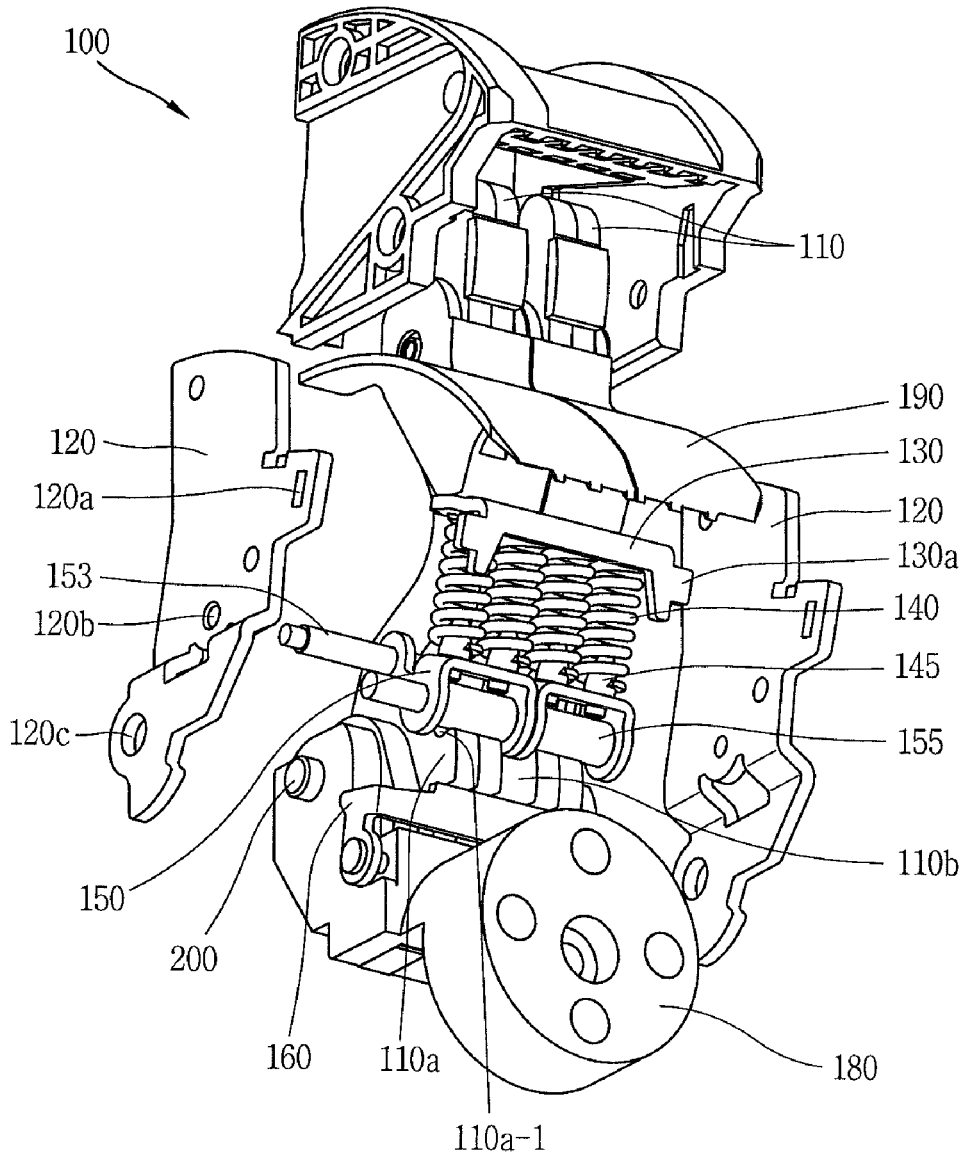
FIG. 9 is a perspective view of the movable contactor assembly viewed askew from a lower side according to a preferred embodiment of the present invention.

The movable contactor 110 is connected to the terminal base 180 by the connection pin 200. A plurality of movable contactors are provided for each of the phases of AC. As shown in FIG. 9, the movable contactor 110 has a cam surface portion 110*a*-1. When a fault current occurs in a circuit to which the current limiting type MCCB is connected, the movable contactor 110 is rotatable to a position at which the movable contactor 110 is separated from the current limiting type fixed contactor 1 of the MCCB by an electromagnetic repulsive force.

Figure 8:
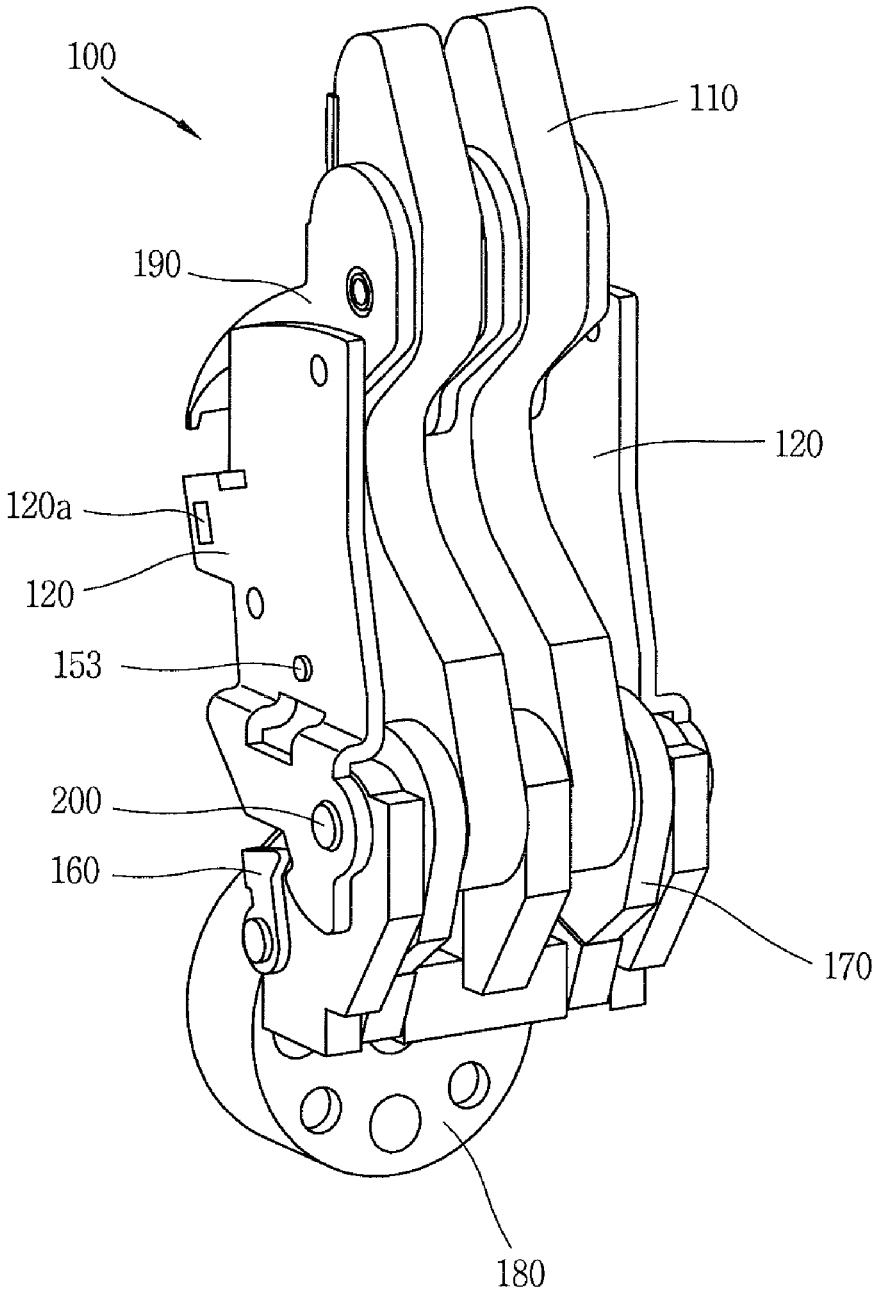
FIG. 8 is a perspective view of the movable contactor assembly viewed askew from an upper side according to a preferred embodiment of the present invention.

As shown in FIGS. 8 and 9, the pair of holder plates 120 are connected to the terminal base 180 by the connection pin 200, and support the movable contactor 110 from both sides thereof. The pair of holder plates 120 can be rotatable along with the movable contactor 110 centering around the connection pin 200. As shown in FIG. 9, each of the holder plates 120 comprises a thin rectangle vertical hole 120*a*, a pin hole 120*b*, and a connection pin hole 120*c*.

As shown in FIG. 9, the plurality of first springs 140 are provided between the pair of holder plates 120, and when the MCCB is a closed circuit, the plurality of first springs 140 provide an elastic force to the movable contactor 110 in a direction in which the movable contactor 110 is brought into contact with the fixed contactor (1 in FIG. 16 and FIG. 18), and when the MCCB performs a current limiting operation, the plurality of first springs 140 provide an elastic force to the movable contactor 110 in a direction in which the movable contactor 110 is separated from the fixed contactor 1. Both end portions of the plurality of first springs 140 are supported by a first spring holder 130 and a second spring holder 150 further comprised in movable contactor assembly 100 for the current limiting type MCCB.

Figure 13:
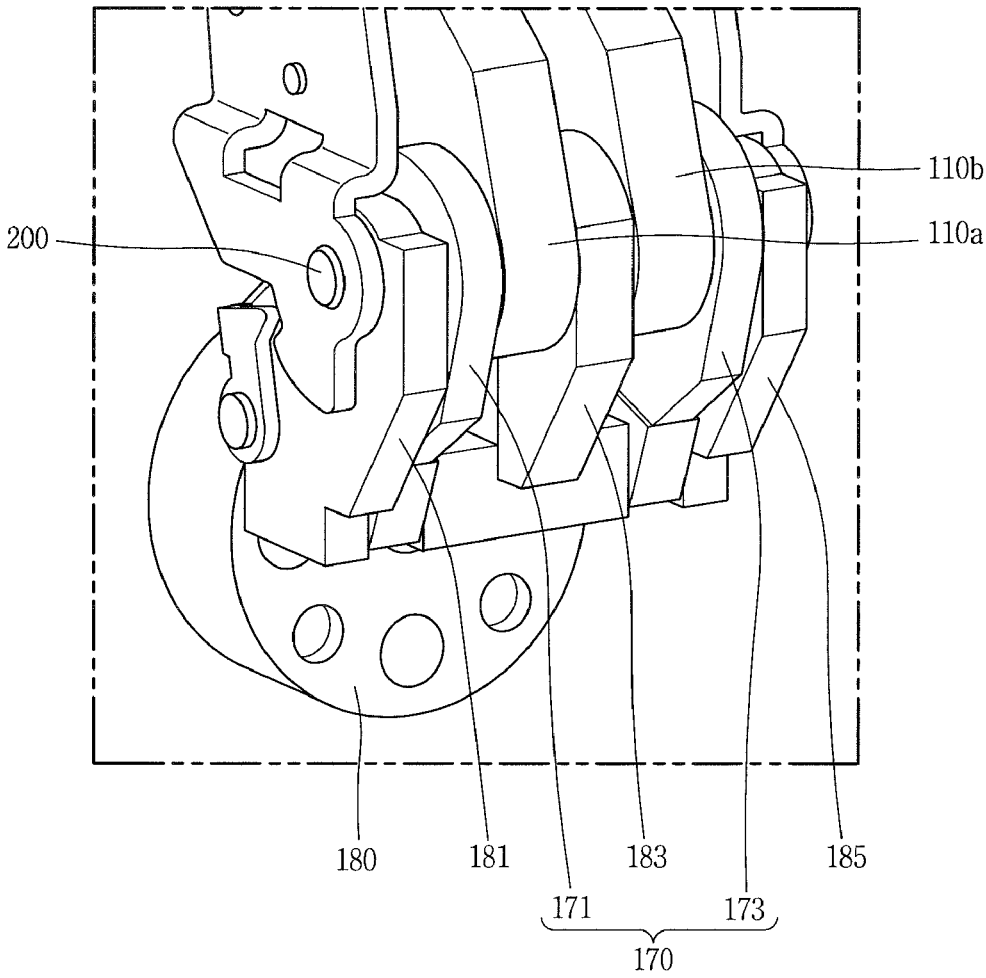
FIG. 13 is a lower perspective view of the movable contactor assembly showing the disposition of a terminal base, extending plate portions, flexible wire plates, and a movable contactor according to a preferred embodiment of the present invention.

As shown in FIG. 13, the plurality of extending plate portions 181, 183, and 185 are portions extending from the terminal base 180. The plurality of extending plate portions 181, 183, and 185 and the terminal base 180 can be integrally fabricated by a mold, or the plurality of extending plate portions 181, 183, and 185 are separately fabricated and then welded to the terminal base 180. Accordingly, the plurality of extending plate portions 181, 183, and 185 are position-fixed along with the terminal base 180 fixed to the case 40 of the MCCB. The plurality of extending plate portions 181, 183, and 185 are provided to face the sides of end portions 110*a* and 110*b* of the movable contactor 110, and electrically connected with the movable contactor 110.

Figure 15:
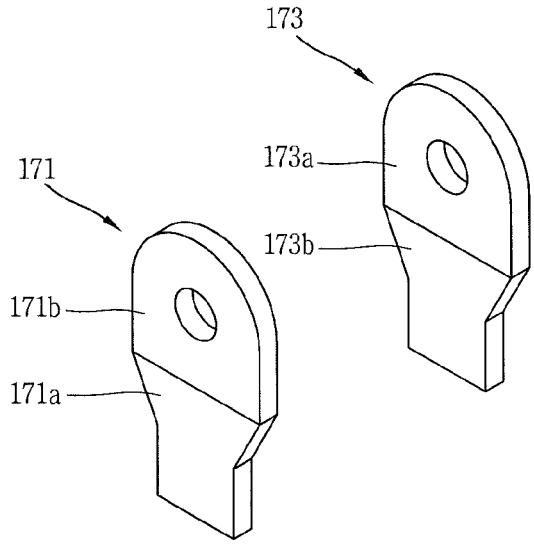
FIG. 15 is a perspective view showing the configuration of the flexible wire plates in the movable contactor assembly according to a preferred embodiment of the present invention.

As shown in FIGS. 13 and 15, the plurality of flexible wire plates 170 may comprise a first flexible plate 171 and a second flexible plate 173.

The first flexible plate 171 and the second flexible plate 173 comprise lower portions 171*a* and 173*b* and upper portions 171*b* and 173*a*.

The fixed portions 171*a* and 173*b* of the flexible plate 170 are welded to the terminal base 180 so as to be fixed.

The flexible portions 171*b* and 173*a* of the flexible plate 170 extend between the movable contactor 110 and the extending plate portions 181, 183, and 185 to electrically connect the movable contactor 110 and the terminal base 180. The flexible portions 171*b* and 173*a* can be bent toward the movable contactor 110 or toward the extending plate portions 181, 183, and 185.

The first flexible plate 171 and the second flexible plate 173 may be configured as plates formed by weaving several strands of conductive flexible wires in the form of a plate, as shown in FIG. 15, the first flexible plate 171 and the second flexible plate 173 may have a through hole formed on the portions 171*b* and 173*a* and allowing the connection pin 200 to pass therethrough, respectively.

Figure 14:
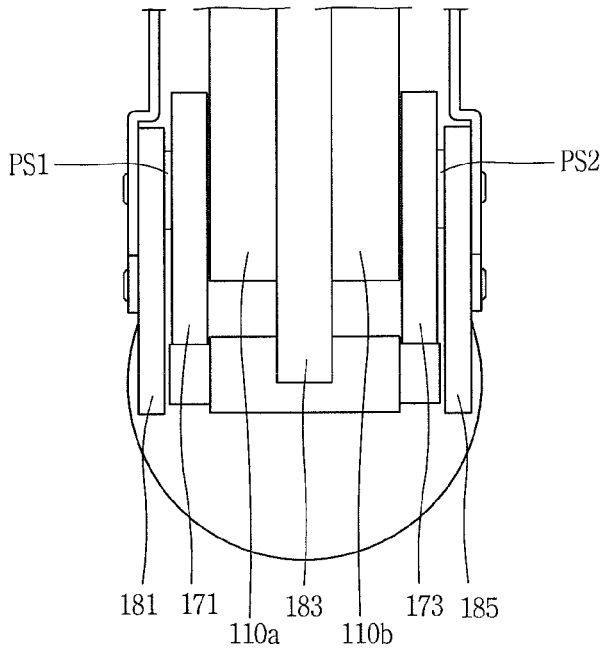
FIG. 14 is a lower front view of the movable contactor assembly showing the disposition of the extending plate portions, flexible wire plates, second springs, and a movable contactor according to a preferred embodiment of the present invention.

As shown in FIG. 14, the second springs PS1 and PS2 are installed between the extending plate portions 181, 183, and 185 and the plurality of flexible wire plates 170 to provide an elastic force to the plurality of flexible wire plates 170 so as to be tightly contacted to the end portions 110*a* and 110*b* of the movable contactor 110. The second springs PS1 and PS2 may be configured as Belleville springs (or Belleville washers) or wave washers.

As shown in FIG. 9, the first spring holder 130 is supported by the two holder plates 120, and supports one end portion of the first spring 140. The first spring holder 130 comprises a first plate portion and an extending portion which is bent at a right angle from the first plate portion so as to extend. The first spring holder 130 comprises a pair of support projections 130*a* extending from both sides of the extending portion and inserted into and supported by the holder plate 120. The first spring holder 130 may comprise a first spring support projection (not shown) protrusively extending from the first plate portion to support one end portion of the first spring 140. Compared with the spring support pin 15 according to the related art, the corresponding first spring support projection (not shown) is shorter than the spring support pin 15 and protruded from the first plate portion of the first spring holder 130. Thus, when the first spring holder 130 is fabricated through pressing, the first spring support projection (not shown) can be integrally fabricated with the first spring holder 130 and satisfy a mechanical strength tolerating the elastic force of the first spring 140.

As shown in FIGS. 9 to 12, the second spring holder 150 is rotatably supported by a support pin 153 having both end portions inserted to the two holder plates 120. The second spring holder 150 supports the other end portion of the first spring 140. Also, the second spring holder 150 transfers an elastic force from the first spring 140 to the movable contactor 110.

Figure 10:
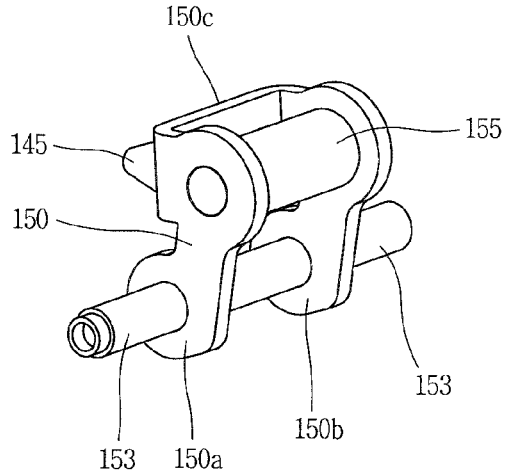
FIG. 10 is a perspective view showing the configuration of a second spring holder of the movable contactor assembly according to a preferred embodiment of the present invention.

With reference to FIG. 10, the second spring holder 150 comprises a pair of side plate portions 150*a* and 150*b*, a connection plate portion 150*c* connecting the pair of side plate portions 150*a* and 150*b* in a horizontal direction, and a plurality of spring support projections 145 provided on the connection plate portions 150*c* and supporting the other end portion of the first spring 140.

With reference to FIGS. 9 to 12, the movable contactor assembly 100 for the current limiting type MCCB according to a preferred embodiment of the present invention further comprises a roller 155.

Figure 11:
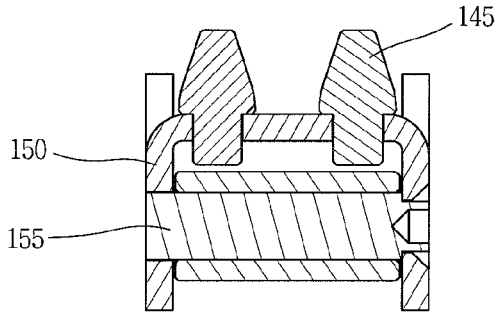
FIG. 11 is a longitudinal sectional view of a second spring holder in FIG. 10.
Figure 12:
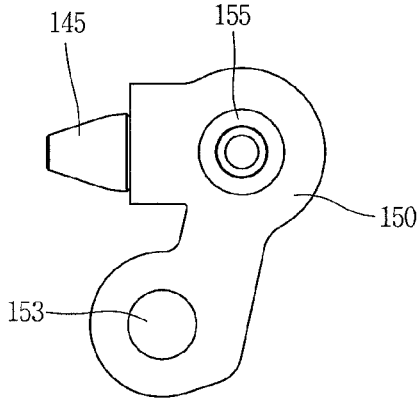
FIG. 12 is a side view of a second spring holder in FIG. 10.

The roller 155 is rotatably supported between the pair of side plate portions 150*a* and 150*b* of the second spring holder 150. The roller 155 transfers an elastic force of the first spring 140 to the cam surface portion (110*a*-1 in FIG. 9) of the movable contactor 110. The roller 155 may comprise a roller shaft and a roller portion rotatably supported by the roller shaft and being in contact with the cam surface portion of the movable contactor 110. Here, as shown in FIG. 9, the roller shaft (no reference number given) may be configured to be protruded from the side of the second spring holder 150, and as shown in FIGS. 10 and 11, the roller shaft may be configured not to be outwardly protruded from the side, namely, the side plate portion 150*a*, of the second spring holder 150.

With such a configuration, when the movable contactor 110 rotates, the roller 155 is rotated on the cam surface portion 110*a*-1 of the movable contactor 110. The cam surface portion 110*a*-1, having the same configuration as that of the contact surface portion 11*a* of the foregoing related art, comprises a slant surface portion and a curved surface portion. When the roller 155 is brought into contact with a lower end of the slant surface portion and the curved surface portion of the cam surface portion 110*a*-1, the first spring 140 extends to provide a rotation moment to the movable contactor 110 in FIG. 9 such that the movable contactor 110 is rotated clockwise (Here, the movable contactor 110 rotates clockwise in a direction in which the movable contactor 110 is brought into contact with the fixed contactor). As the roller 155 approaches the upper end of the slant surface portion of the cam surface portion 110*a*-1, the distance between the first spring holder 130 and the second spring holder 150 is reduced and the first spring 140 placed between the first spring holder 130 and the second spring holder 150 is compressed.

The first spring holder 130 and the second spring holder 150 can be fabricated through pressing. Thus, the movable contactor assembly according to a preferred embodiment of the present invention comprises the spring support mechanism having components which can be easily fabricated through pressing, so the production cost and time can be reduced compared with the spring support mechanism including processed components fabricated through cutting by a lathe according to the related art.

As shown in FIG. 7, the movable contactor assembly for the current limiting type MCCB according to an preferred embodiment of the present invention may further comprise an insulation holder 4 made of an electrically insulating material.

The insulation holder 4 is connected to the pair of holder plates 120 so as to be rotatable with the holder plates 120, and accordingly, the insulation holder 4 can be also rotatable along with the movable contactor 110. A detailed configuration and function of the insulation holder 4 have been described above with reference to FIGS. 4 to 7, so a repeated description thereof will be omitted.

As shown in FIGS. 8 and 9, the movable contactor assembly 100 for the current type MCCB according to a preferred embodiment of the present invention further comprises a catch 160 fixed to the terminal base 180 and determining a rotation limitation of the movable contactor 110. The configuration and function of the catch 160 are the same as the catch 16 according to the related art, so a detailed description thereof will be omitted.

The operation of the movable contactor assembly for the current limiting type MCCB according to a preferred embodiment of the present invention will now be described with reference to FIGS. 16 to 18.

First, a circuit closing operation of the movable contactor assembly according to a preferred embodiment of the present invention will be described with reference to FIGS. 4, 5 and 16.

The handle 32 is rotated to a right side (clockwise) from the position in FIG. 4 to an OFF position, namely, a breaking position, and in this state, the handle 32 is grasped and rotated counterclockwise as shown in FIG. 4. Then, the upper link (22*b* in FIG. 4) having a lower portion connected to the lower link member of the second link member 34 is rotated clockwise. Accordingly, the lower link (6 in FIG. 6) connected to the upper link by a link pin (not shown) is rotated counterclockwise, and at this time, the insulation holder 4 connected to the lower link 6 by a connection pin, the holder plate (120 in FIG. 5) connected to the insulation holder 4 by a connection pin, and the movable contactor 110 connected to the holder plate 120 by a connection pin (200 in FIG. 8) are also rotated counterclockwise by using the terminal base 180 as a supporting point. Accordingly, the movable contactor 110 is rotated to a position at which the movable contactor 110 is brought into contact with the fixed contactor 1 so as to be in the state as shown in FIG. 16. Accordingly, the circuit is connected between the electric power source side and the electric load side to allow current to flow therethrough.

As shown in FIG. 16, an elastic force S1 of the first spring 140 acts as a contact pressure R1 applied to the movable contactor 110 by the roller (155 in FIG. 9) with the second spring holder 150 interposed therebetween. The distance in straight line from the center of the connection pin 200, a rotation supporting point of the movable contactor 110 to the acting line of the contact pressure R1, namely, the length of the moment arm is M1, and the moment determined by the multiplication of the contact pressure R1 and the length of the moment arm M1 acts to enable the movable contactor 110 to be rotated counterclockwise, so the movable contactor 110 is maintained in a state of being in contact with the corresponding fixed contactor 1 by the contact pressure R1.

A current limiting operation of the movable contactor assembly according to an preferred embodiment of the present invention will now be described with reference to FIGS. 4, 5, 17, and 18.

When a large fault current, such as a short-circuit current, occurs on the circuit at a position at which the movable contactor 110 is in contact with the fixed contactor 1, namely, at an ON position in the circuit to which the MCCB is connected, the trip mechanism detects the fault current as described above. In this case, before the trip mechanism triggers the switching mechanism 30 to perform a trip operation, a strong repulsive force, namely, an electromagnetic repulsive force, is generated between the magnetic forces in the same direction generated around the movable contactor 110 and the fixed contactor 1. Such an electromagnetic repulsive force independently rotates the movable contactor 110 in a direction in which the movable contactor 110 is separated from the corresponding fixed contactor 1 regardless of the transmission of a driving force through the switching mechanism 30, the links 6, 22*a*, 22*b*, and 22*c*, and the holders 4 and 120. Namely, a current limiting operation is performed.

Figure 17:
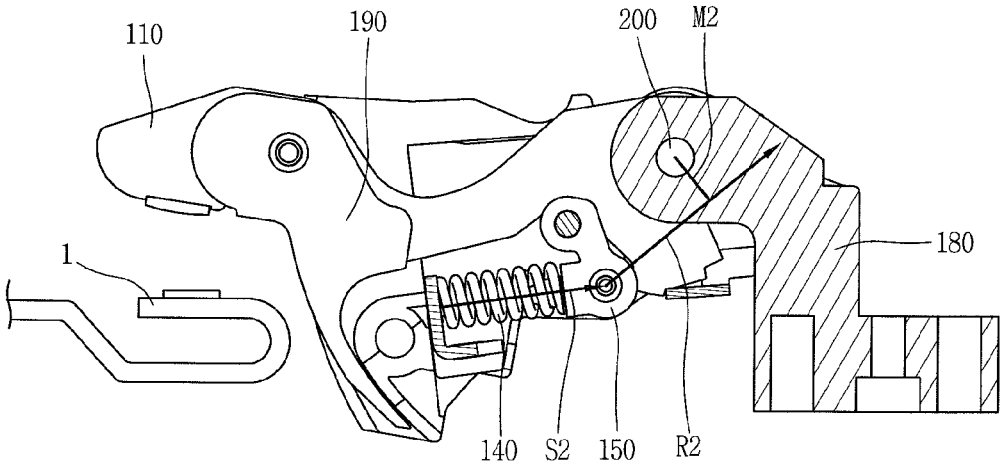
FIG. 17 is a longitudinal sectional view showing an operational state in the course of a current limiting operation in the movable contactor assembly according to a preferred embodiment of the present invention.

FIG. 17 shows an operational state of the movable contactor assembly according to a preferred embodiment of the present invention in the course of the current limiting operation.

With reference to FIG. 17, as the movable contactor 110 is rotated to a position at which the movable contactor 110 is separated from the fixed contactor 1 according to an electromagnetic repulsive force, an elastic force S2 of the first spring 140 acts as a contact pressure R2 applied to the movable contactor 110 by the roller (155 in FIG. 9) with the second spring holder 150 interposed therebetween. The distance in straight line from the center of the connection pint 200, a rotation supporting point of the movable contactor 110 to the acting line of the contact pressure R2, namely, the length of the moment arm is M2, which is shortened as it is approached to the center of the connection pin 200. Thus, the moment by the contact pressure R2 that rotates the movable contactor 110 counterclockwise, namely, the moment expressed by the multiplication of the contact pressure R2 and the length M2 of the moment arm is sharply reduced.

Figure 18:
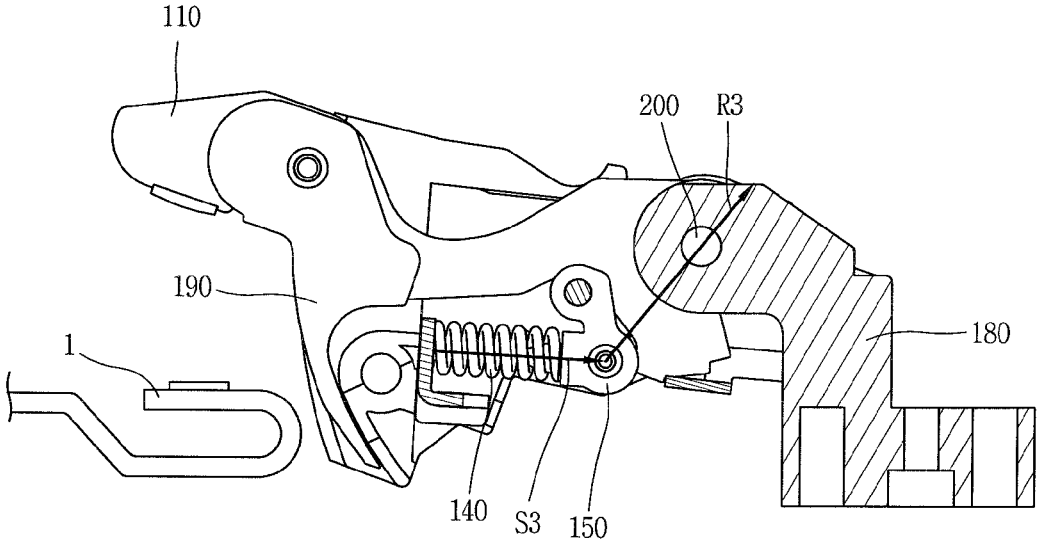
FIG. 18 is a longitudinal sectional view showing a final operational state of a current limiting operation in the movable contactor assembly according to a preferred embodiment of the present invention.

FIG. 18 is a vertical sectional view showing a final operational state of a current limiting operation in the movable contactor assembly according to an preferred embodiment of the present invention.

As shown in FIG. 18, in the final operational state of the current limiting operation, the movable contactor 110 is rotated to a position at which the movable contactor 110 is separated from the fixed contactor 1 to its maximum level by the electromagnetic repulsive force, and an elastic force S3 of the first spring 140 of the first spring 140 acts as a contact pressure R3 applied to the movable contactor 110 by the roller (155 in FIG. 9) with the second spring holder 150 interposed therebetween. In this case, the contact pressure S3 passes through the center of the connection pin 200, the rotation supporting point of the movable contactor 110 and the length of the moment arm is zero (0). Accordingly, the moment by the contact pressure R3 that rotates the movable contactor 110 counterclockwise, namely, the moment expressed as the multiplication of the contact pressure R3 and the length of the moment arm is zero and, as shown in FIG. 18, the movable contactor 110 is stopped at a position at which the movable contactor 110 is separated from the fixed contactor 1 to its maximum level.

Accordingly, a current limiting effect by a fault current in the circuit can be obtained until when a trip operation is performed by the trip mechanism and the switching mechanism.

Also, because the movable contactor assembly for the current limiting type MCCB has a configuration in which the movable contactor and the extending plate portion of the terminal base are pushed to be brought into contact by the flexible wire plate elastically supported by the spring, the contact resistance between the movable contactor and the terminal base can be reduced, and thus, electric power transmission efficiency between the movable contactor and the terminal base can be improved.

In addition, in the movable contactor assembly for the current limiting type MCCB, the roller 155 and the roller support mechanism 150 can be reduced in terms of a component number compared with the related art, the components can be simplified in number compared with the related art, and thus, the assembling productivity can be improved.

Moreover, in the movable contactor assembly for the current limiting type MCCB, because the support mechanisms 130, 145 and 150 of the first spring are fabricated through pressing, they can be quickly fabricated at a low cost.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A movable contactor assembly for a current-limiting-type molded case circuit breaker, the assembly comprising:

a terminal base formed from an electric conductor, the terminal base fixedly installed on a case of the molded case circuit breaker and providing a supporting base;

a plurality of movable contactors that are connected to the terminal base by a connection pin, are provided at each phase of an Alternating Current, having a cam face portion, and are movable to a position such that the plurality of movable contactors are separated from current-limiting-type fixed contactors of the molded case circuit breaker by an electromagnetic repulsive force when a fault current exists in a circuit to which the molded case circuit breaker is connected;

a pair of holder plates that are connected to the terminal base by the connection pin, that support both sides of the plurality of movable contactors, and are rotatable;

a plurality of first springs provided between the pair of holder plates and configured to:

provide an elastic force to the plurality of movable contactors in a direction such that the plurality of movable contactors are brought into contact with the current-limiting-type fixed contactors when the molded case circuit breaker is in a closed circuit state, and provide an elastic force to the plurality of movable contactors in a direction such that the plurality of movable contactors are separated from the current-limiting-type fixed contactors when the molded case circuit breaker performs a current limiting operation;

a plurality of extending plate portions extending from the terminal base and configured to face a side of one end portion of each of the plurality of movable contactors such that the plurality of extending plate portions is electrically connected to the plurality of movable contactors;

a plurality of flexible wire plates having a first portion fixedly connected to the terminal base and a second portion extending between the plurality of movable contactors and the plurality of extending plate portions to electrically connect the plurality of movable contactors and the terminal base, the plurality of flexible wire plates bendable toward the plurality of movable contactors or toward the plurality of extending plate portions; and a second spring installed between the plurality of extending plate portions and the plurality of flexible wire plates to provide an elastic force to the plurality of flexible wire plates such that the plurality of flexible wire plates tightly contact the plurality of movable contactors.

2. The assembly of claim 1, further comprising:

a first spring holder supported by the pair of holder plates and configured to support a first end portion of each of the plurality of first springs; and a second spring holder that is rotatably supported by the support pin that is inserted into the pair of holder plates, the second spring holder configured to:

support a second end portion of each of the plurality of first springs, and transfer the elastic force from each of the plurality of first springs to each of the plurality of movable contactors.

3. The assembly of claim 2, wherein the second spring holder comprises:

a pair of side plate portions;

a connection plate portion connecting the pair of side plate portions in a horizontal direction; and a plurality of spring support projections provided on the connection plate portion and supporting the second end portion of each of the plurality of first springs.

4. The assembly of claim 3, further comprising:

a roller rotatably supported between the pair of side plate portions and transferring the elastic force from the plurality of first springs to the cam face portion of the plurality of movable contactors.

5. The assembly of claim 1, wherein each of the plurality of flexible wire plates comprises:

a fixed portion welded to the terminal base; and a flexible portion that extends from the fixed portion, is inserted between the plurality of extending plate portions and the plurality of movable contactors to electrically connect the plurality of extending plate portions and the plurality of movable contractors, and is bendable toward the plurality of movable contactors or toward the plurality of extending plate portions.

6. The assembly of claim 1, wherein the plurality of flexible wire plates are configured as a plurality of conductive flexible wires.

7. The assembly of claim 1, further comprising:

an insulating holder that is connected to the pair of holder plates, rotatable along with the pair of holder plates, and made of an electrical insulating material.

* * * * *

UNITED STATES PATENT AND TRADEMARK OFFICE

CERTIFICATE OF CORRECTION

PATENT NO. : 8,264,306 B2
APPLICATION NO. : 13/010698
DATED : September 11, 2012
INVENTOR(S) : Ki Ho Baek It is certified that error appears in the above-identified patent and that said Letters Patent is hereby corrected as shown below:

Title page, item [73] should read as follows:

Assignee: LS Industrial Systems Co., Ltd.
Anyang (KR)

Signed and Sealed this
Thirtieth Day of July, 2013

Teresa Stanek Rea

Teresa Stanek Rea
*Acting Director of the United States Patent and Trademark Office*